US007811029B2

(12) United States Patent
Graham et al.

(10) Patent No.: US 7,811,029 B2
(45) Date of Patent: Oct. 12, 2010

(54) WOVEN SOIL STABILIZATION SYSTEM

(75) Inventors: William T. Graham, Evansville, WI (US); Mark Doudlah, Evansville, WI (US); William N. Isermann, Marshall, WI (US); Jay Settersten, Cambridge, WI (US); Robert A Walker, Edgerton, WI (US); Paul Collins, Janesville, WI (US)

(73) Assignee: Agrecol, LLC, Madison, WI (US)

( * ) Notice: Subject to any disclaimer, the term of this patent is extended or adjusted under 35 U.S.C. 154(b) by 0 days.

(21) Appl. No.: 11/673,478

(22) Filed: Feb. 9, 2007

(65) Prior Publication Data

US 2008/0193229 A1 Aug. 14, 2008

(51) Int. Cl.
*E02B 3/04* (2006.01)

(52) U.S. Cl. ..... 405/17; 405/302.6; 405/302.7

(58) Field of Classification Search ..... 405/302.4, 405/302.6, 302.7, 262, 284, 16, 17
See application file for complete search history.

(56) References Cited

U.S. PATENT DOCUMENTS 1,629,315 A * 5/1927 Scott ..... 442/186
3,374,635 A * 3/1968 Crandall ..... 405/18
4,486,121 A 12/1984 Thompson et al.
4,779,393 A 10/1988 Jong
5,580,191 A 12/1996 Egan
5,934,027 A 8/1999 Khalili
2005/0005566 A1 1/2005 Kim

FOREIGN PATENT DOCUMENTS

CA 2369310 7/2003
JP 03036321 A * 2/1991
JP 06-322730 11/1994

* cited by examiner

*Primary Examiner*—Sunil Singh
(74) *Attorney, Agent, or Firm*—Michael Best & Friedrich LLP

(57) ABSTRACT

A soil stabilization system comprised of recent courses of soil bags woven and/or intertwined with geogrid and soil stabilization bodies pierce the soil stabilization bodies and protrusions on sides which protrude into the soil bags of the adjacent courses. Protrusions on the soil stabilization bodies shall protrude through holes in the geogrid to help anchor the soil bags relative to each other.

20 Claims, 10 Drawing Sheets

FIG. 6(e)
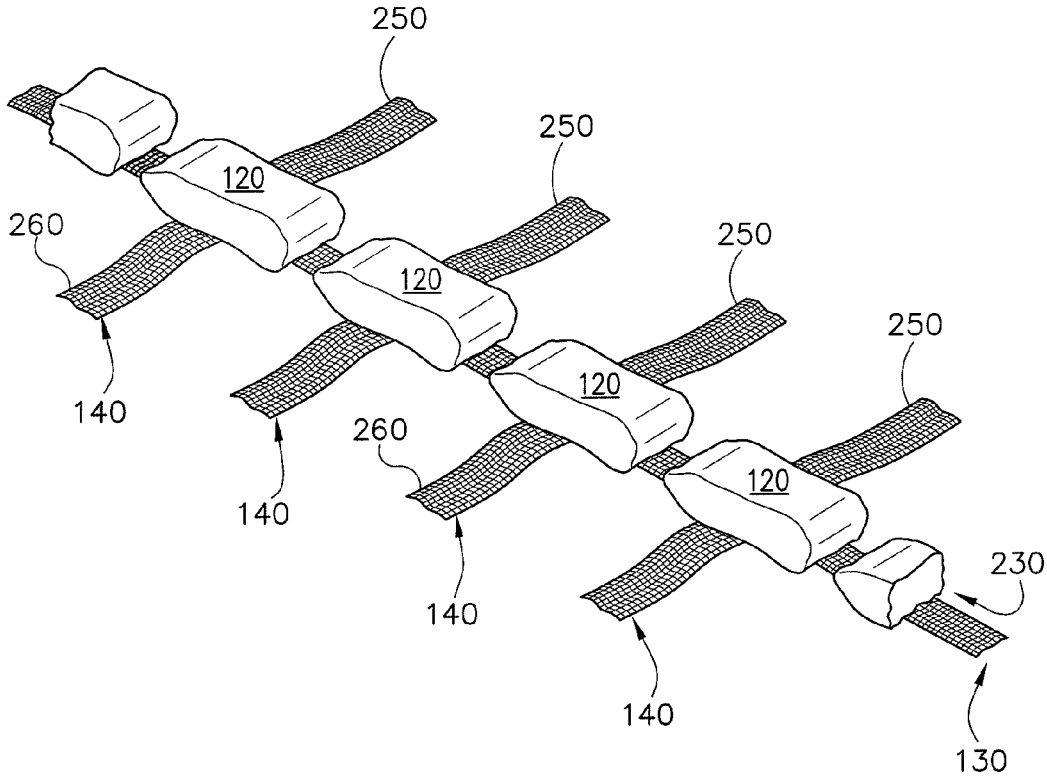
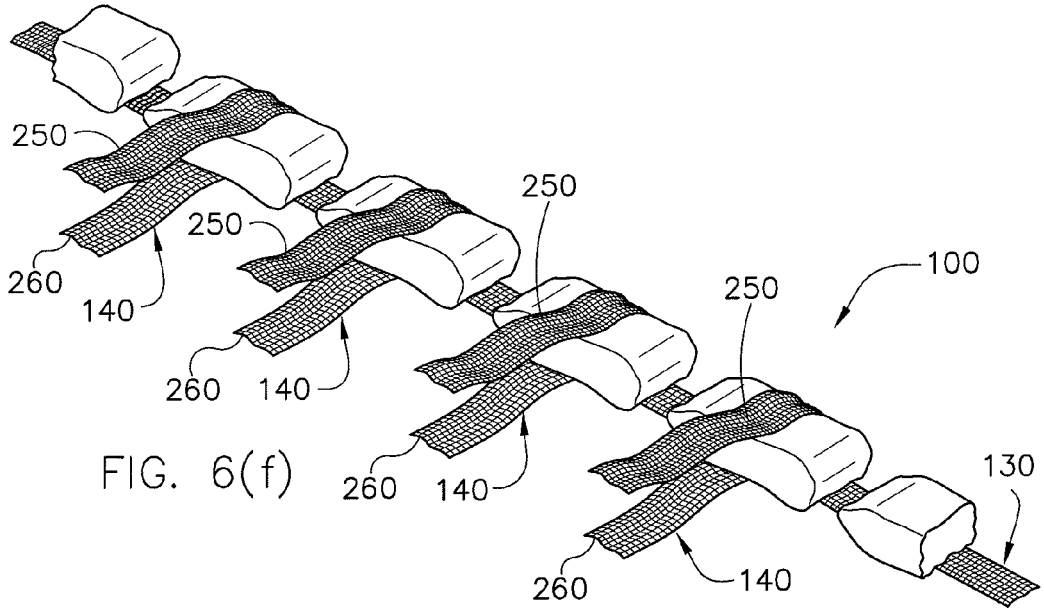
FIG. 6(f)

FIG. 6(g)
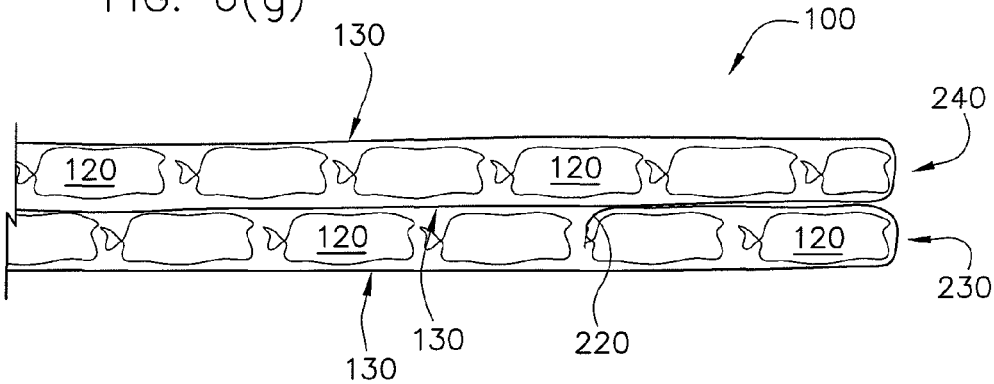
FIG. 6(h)
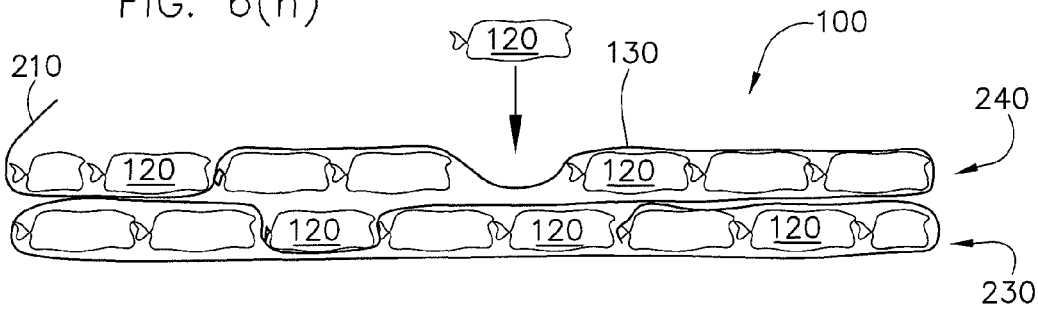
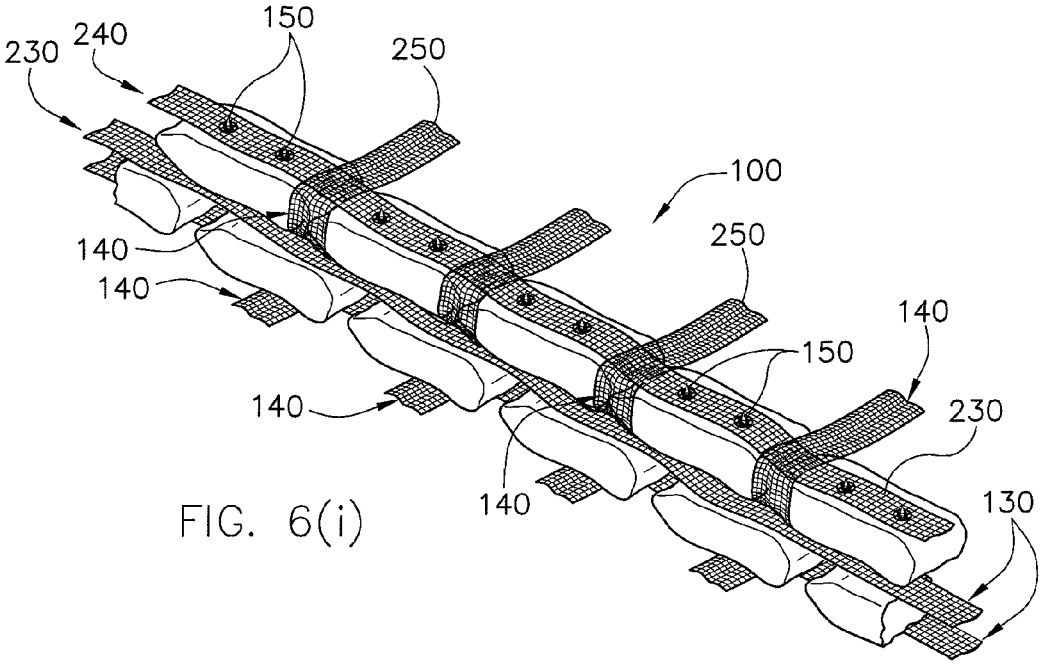
FIG. 6(i)

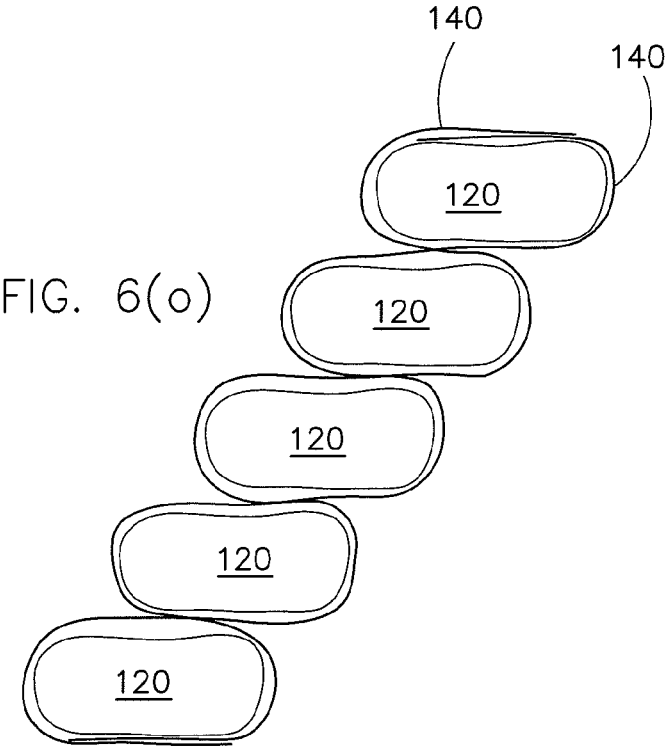
FIG. 6(o)
FIG. 6(p)
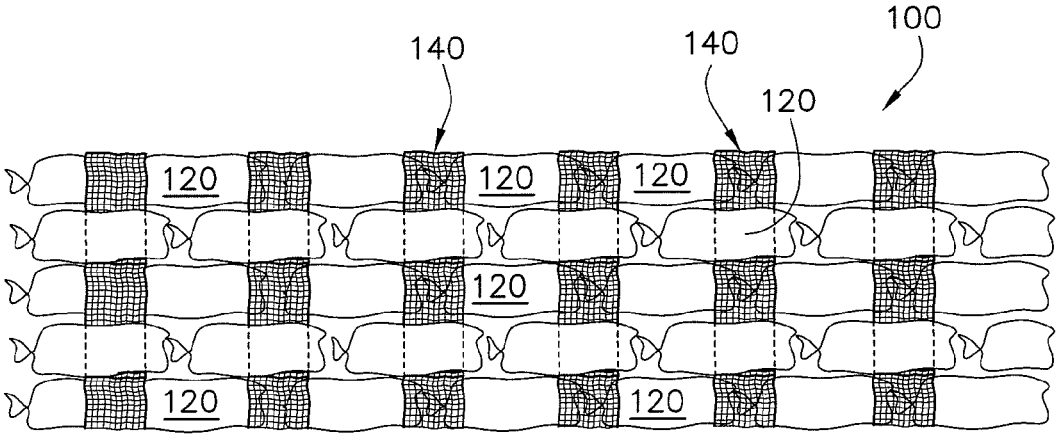

WOVEN SOIL STABILIZATION SYSTEM

STATEMENT REGARDING FEDERALLY SPONSORED RESEARCH OR DEVELOPMENT

Not applicable.

FIELD OF THE INVENTION

The present invention pertains to woven soil stabilization systems and methods of constructing soil stabilization systems. In particular, it pertains to soil stabilization systems comprised of soil bags interfaced with geogrid materials.

BACKGROUND OF THE INVENTION

It is known to build retaining walls, containment systems, levies and/or other similar structures using soil bags. Often, soil bags in retaining walls are not affixed to each other. Rather, gravity and friction are often relied upon to help hold soil bags in place. It is also known to use an impervious plate having a plurality of spikes protruding therefrom to hold soil bags in place, and to anchor sheets of geogrid material extending from between courses of soil bags into the fill retained by the soil bag wall. Such plate is positioned on top of a first layer of soil bags, and then a second layer of soil bags is placed thereupon. Accordingly, the spikes, which generally extend from the top and the bottom of the plate, puncture the vertically and horizontally adjacent soil bags in contact with those spikes to help hold the soil bags in place. Such plates may also have projections to protrude through holes in the geogrid sheet to anchor the soil bag wall to the reinforced soil structure.

While gravity, friction and the known plates may initially hold soil bags in place, the soil bags may shift and move over time. In particular, impervious plates serve as a barrier to water and plant growth that might otherwise drain and grow through the soil bags. For example, such plates prevent plant growth from penetrating the soil bags to help lock them into place. As such, a retaining wall structure incorporating the known plates may be prone to deteriorate more quickly. Further, such plates are not recommended for use with soil bags comprised of material that may degrade or decompose over time as the material comprising the soil bags is needed to help retain particles in the soil bags and otherwise stabilize the structure incorporating the soil bags.

Thus, there is a long felt need for an improved system that may be used to help hold soil bags in place and otherwise strengthen a retaining wall, containment system, levy and/or other similar structure. In addition, there is a need for a system with components that may be easily penetrated by roots and water to support plant growth between soil bags.

SUMMARY

The present invention provides an improved system and method for stabilizing and securing a retaining wall or similar structure, comprising an interwoven system of soil bags and geogrid weaver strips.

The present invention overcomes the aforementioned drawbacks by providing an improved system for stabilizing a retaining wall comprising soil bags.

It is one aspect of the present invention to provide an apparatus and system having a plurality of passages therethrough to facilitate the draining of water and growth of plants through and between soil bags to improve the overall strength of a retaining wall or similar structure.

It is yet another aspect of the present invention to provide a system that may be successfully used with soil bags comprising a degradable or decomposable material.

In accordance with one aspect of the invention, a system is disclosed that comprises at least one geogrid weaver strip that may be woven or twined between a plurality of soil bags to bind the soil bags together as a unit.

This Summary is neither intended nor should it be construed as being representative of the full extent and scope of the present invention. The present invention is set forth in various levels of detail in the Summary as well as in the attached drawings and the detailed description of the exemplary embodiments, and no limitation as to the scope of the present invention is intended by either the inclusion or non-inclusion of the elements, components, etc., in this Summary. Additional aspects, features and advantages of the present invention will become more readily apparent from the Detailed Description of Embodiments, particularly when taken together with the drawings.

BRIEF DESCRIPTION OF DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details which are not necessary for understanding the invention and/or which render other details difficult to perceive may have been omitted. In some drawings, soil bags which are normally positioned closely adjacent to each other are shown in spaced relation to facilitate a description and understanding of the weaving method employed. It should be understood, of course, the invention is not necessarily limited to the particular embodiments illustrated herein.

DETAILED DESCRIPTION OF EXEMPLARY EMBODIMENTS

Figure 1:
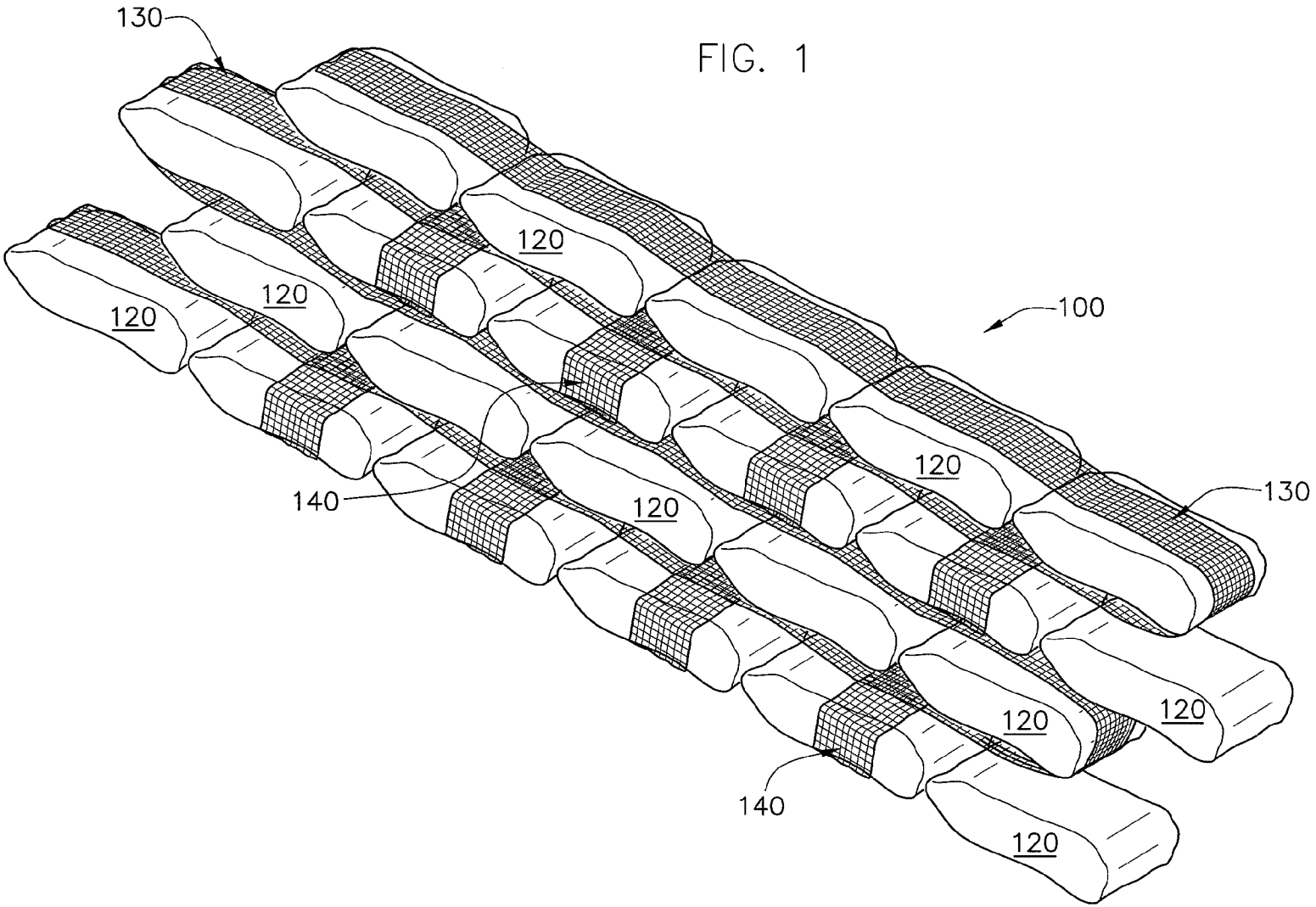
FIG. 1 is a perspective view of an exemplary embodiment of a soil stabilization system.
Figure 2:
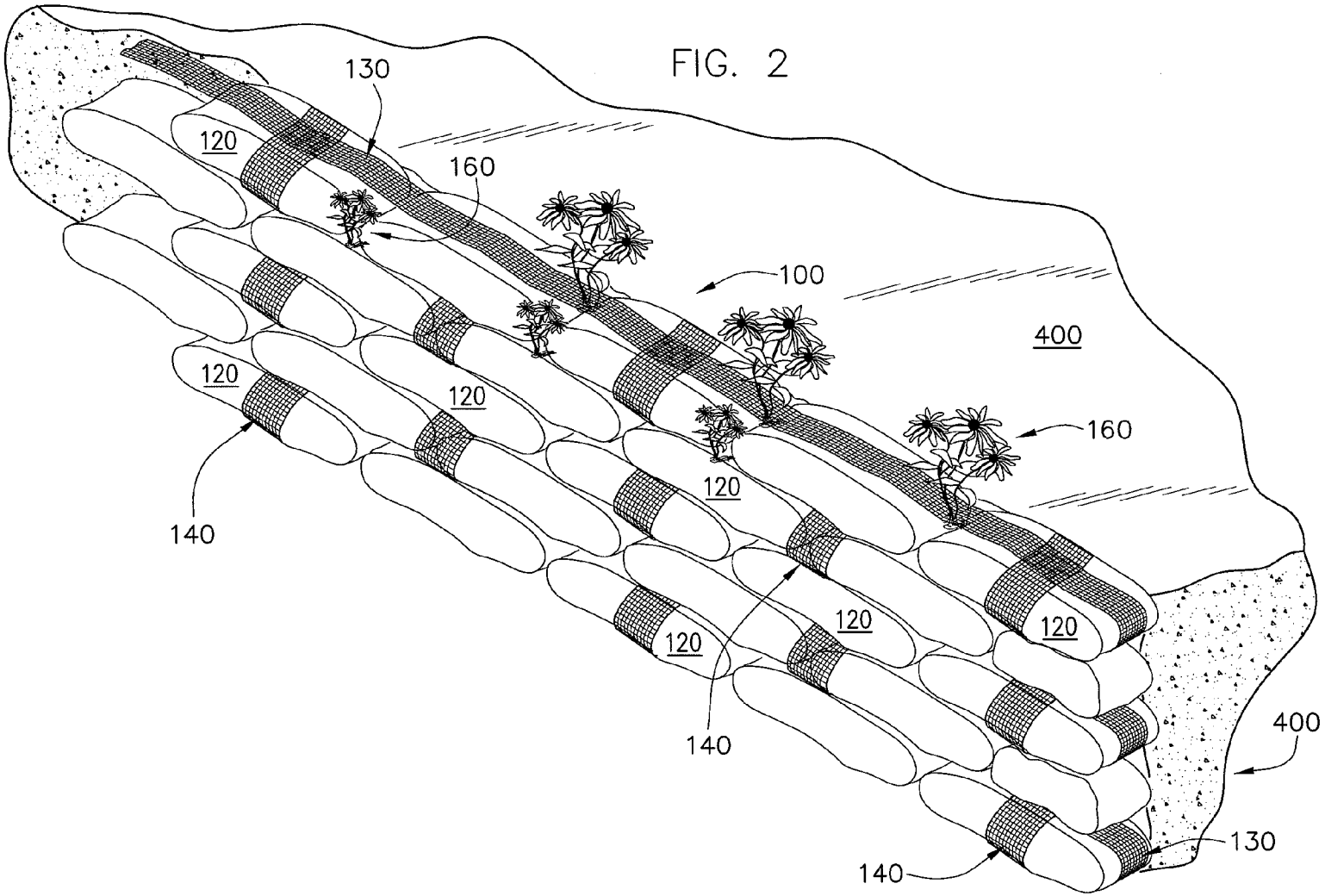
FIG. 2 is a perspective view of an exemplary embodiment of a soil stabilization system.

Referring to FIGS. 1-2, in one embodiment the soil stabilization system 100 comprises a plurality of generally horizontally-laid courses of soil bags 120 which form a soil retainer wall, each course being arranged substantially vertically relative to the others. As shown in FIG. 1, the soil stabilization system 100 may also be substantially sloped if desired. In one exemplary embodiment, the soil stabilization system 100 may be stepped back at a 2 to 1 slope, wherein each succeeding course of bags is set back from the front of the underlying course of bags a horizontal distance of approximately one half the vertical thickness of the filled soil bags.

In the specification, "soil bag" 120 means a cover filled with any suitable fill material, including sand, soil, and mixtures thereof, and may also include fill mixed with seeds for grass or other plants. It is contemplated that the covers of the soil bags 120 may be formed from a variety of materials or combinations of such materials. In accordance with one embodiment, the covers of the soil bags 120 are comprised of needle-punch non-woven fabric such that, as will be described, plants may grow through the soil bags 120 and/or holes formed in at least the covers of the soil bags 120. For example, the covers of the soil bags 120 may be a polypropylene, staple fiber, needle-punched, or non-woven geotextile. In one embodiment, the covers of the soil bags 120 may be comprised of woven fabric that allows plant growth to grow through the soil bags 120 and/or holes formed in the covers of the soil bags 120, and may also ultimately decompose over time. The covers of the soil bags 120 may also comprise any other materials or combination of materials that will decompose or otherwise degrade over time.

The soil bags 120 and/or the fill material may include seeds that, after formation of the soil stabilization system 100 will produce plant growth 160. In the specification, "plant growth" means any portion of any type of plant or plants, including portions such as roots and crowns of a plant or plants. A wide variety of seeds may be used to create various plant growth 160 from any number of types of plants including wild flowers, legumes, grasses, sedges and woody plants with extensive root structures. In one exemplary embodiment, indigenous plants and plant growth may be used. In one embodiment, as the plant growth matures, the plant growth extends through the soil bags 120, and even into the ground or other surface below the soil stabilization system 100, to reinforce the soil.

The soil stabilization system 100 further comprises at least one geogrid weaving strip 130 and/or geogrid twining strip 140. In one embodiment, at least one geogrid weaving strip 130 is woven longitudinally between courses of soil bags of the soil stabilization system 100. In one embodiment, at least one geogrid twining strip 140 is twined between courses of soil bags 120 in at least one of a substantially vertical and a substantially lateral direction relative to the soil stabilization system 100. As will be shown below, the soil stabilization may advantageously comprise various combinations of soil bags and geogrid weaving and twining strips to hold the bags in a desired way. Because the soil stabilization system 100 utilizes plant growth and/or at least one geogrid strip 130/140, one or more of the soil bags 120 used in forming the soil stabilization system 100 may comprise biodegradable, photo degradable, or otherwise decomposable material without substantially compromising the durability of the soil stabilization system 100. As will be discussed in greater detail below, the soil stabilization system 100 may also comprise soil stabilizer bodies (not shown in FIGS. 1-2) to help hold the soil bags 120 and/or and geogrid strips 130/140 in a desired position.

Figure 3:
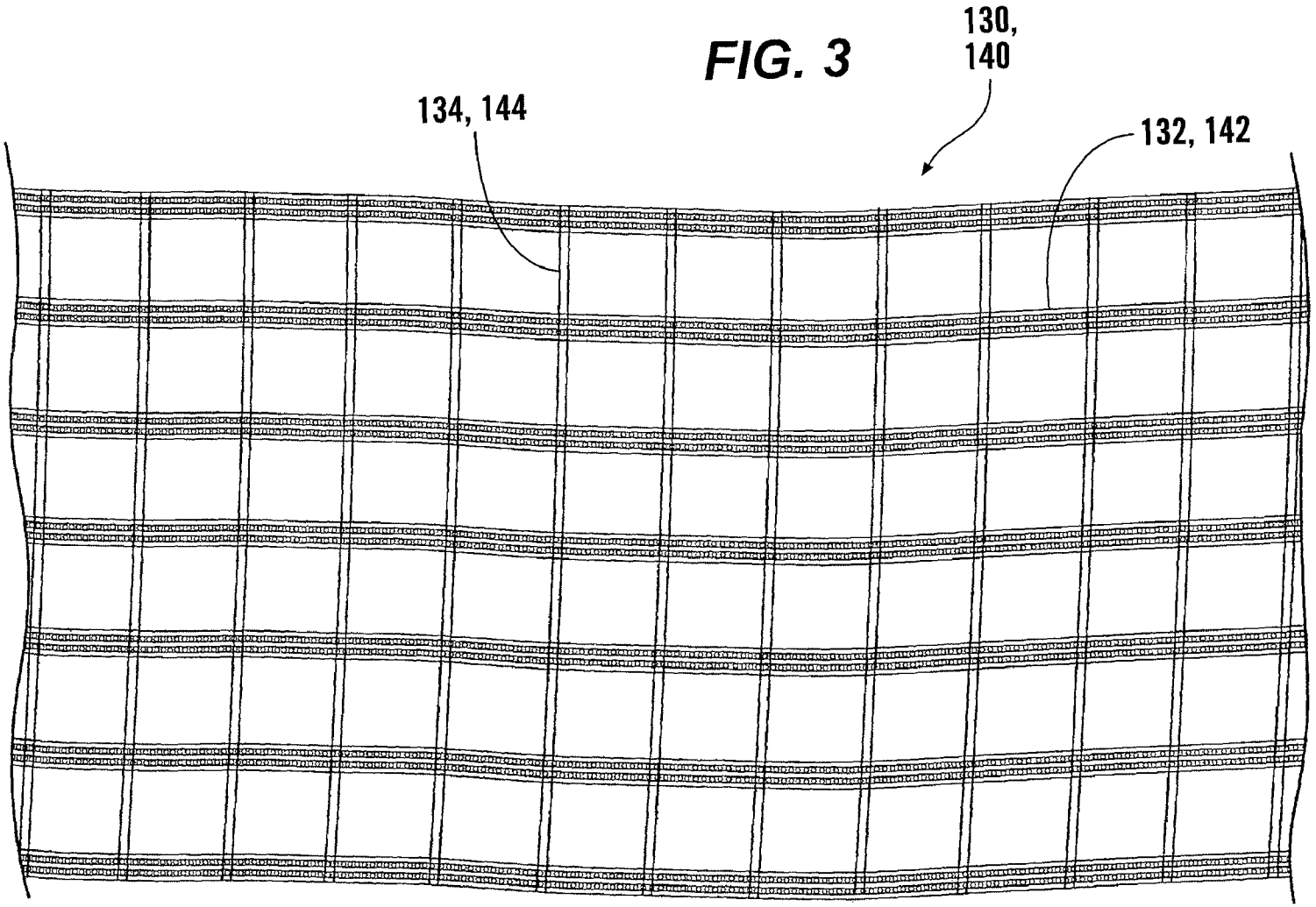
FIG. 3 is a is a plan view of an exemplary embodiment of a geogrid strip.

Geogrid material is known and commercially available as plastic mesh sheet products commonly used for soil reinforcement. Conventional geogrid material is typically sold in rolls of material having a sheet width of 12 to 14 feet, and such sheets are cut to desired lengths from a roll and embedded in soil and various applications to reinforce the soil and resist erosion thereof. FIG. 3 shows an improved geogrid material according to the present invention, wherein strips of material are specially configured in their desired widths for the purpose of weaving the strips around and between soil bags to anchor and retain the soil bags in position within a retaining wall or other soil retaining structure constructed of soil bags.

As shown in FIG. 3, the geogrid strip 130,140 may have a plurality of spaced, linearly extending members 132, 142, shown in spaced, horizontal alignment, and several transverse members 134, 144, shown in a vertical alignment. Each of the linearly extending members 132, 142 and transverse members 134, 144 is made of multiple strands of plastic having a desired tensile strength which are banded, woven or otherwise held together. At the terminal ends of the transverse members 134, 144, each transverse member 134, 144 may be heat fused to the marginal linearly extending member 132, 142.

While the overall length and width of each geogrid strip of the present invention may vary for various soil bag stabilization systems according to the present invention, the geogrid strips 130/140 are generally narrow in width to allow the strips to be wrapped under, over, around and between individual soil bags in a wall or other structure to lock or anchor the soil bags in position within an integrated wall structure wherein the individual soil bags and geogrid strips woven there through are held together by the combined action of the soil bags and woven geogrid material. Typically, the width of the weaving strips will be less than the width of the soil bags with which the strips will be used. In one embodiment, each geogrid strip 130/140 is between 2 inches and 6 inches in width and between 50 feet and 250 feet in length. In one embodiment, each geogrid strip 130/140 is approximately 4 inches in width and 100 feet in length. The only limits on the desired length of the strips are the size of the rolls produced, and the ease and economy of working with several rolls on a job to facilitate use by several workers on the same job.

Figure 4:
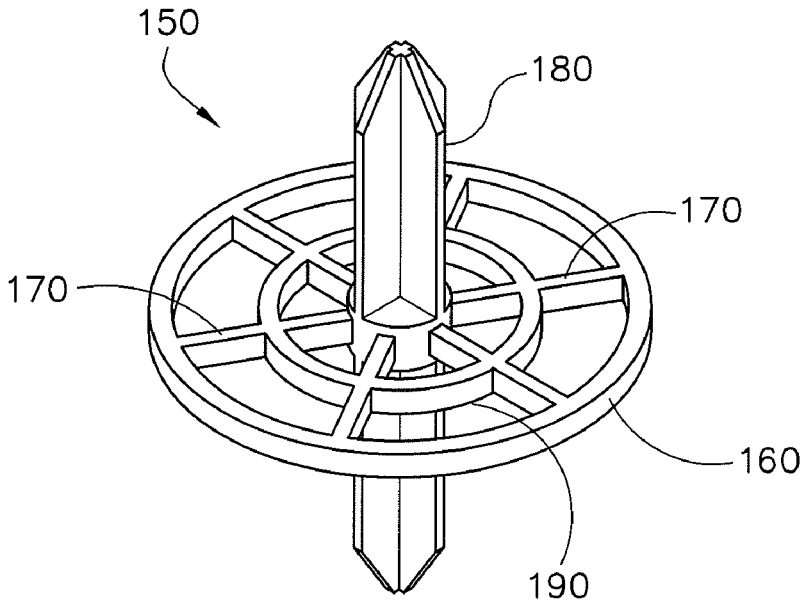
FIG. 4 is a perspective view of an exemplary embodiment of a soil stabilization body.
Figure 5:
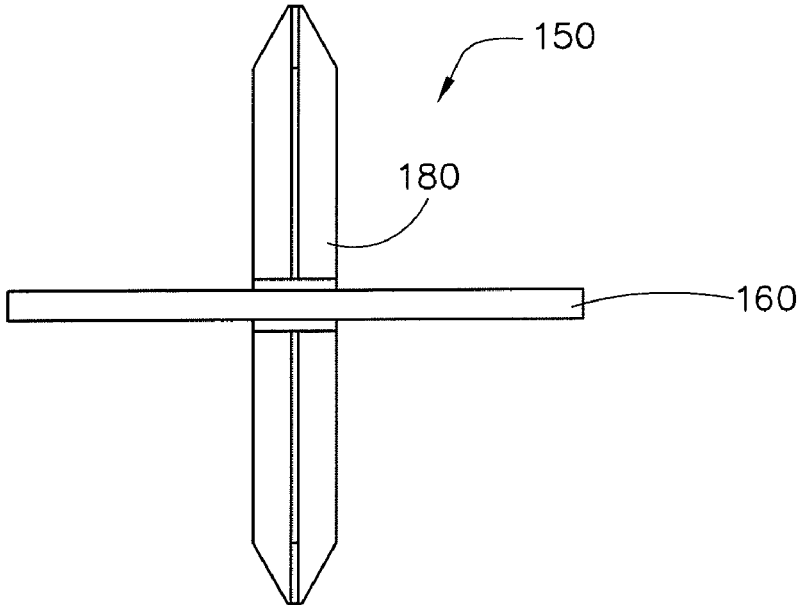
FIG. 5 is a side view of an exemplary embodiment of a soil stabilization body.
Figure 6A:
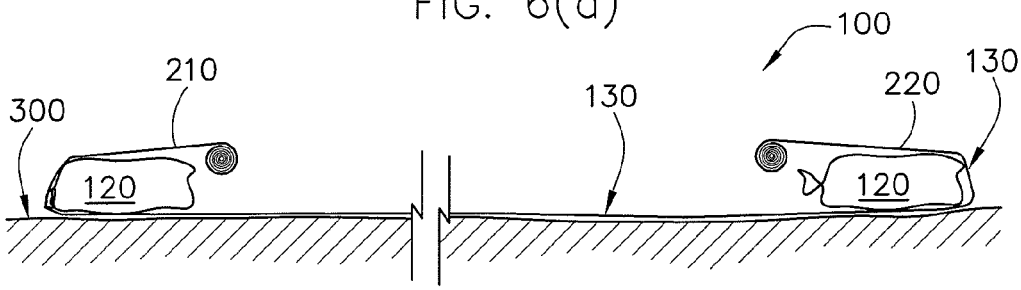
FIGS. 6(*a*)-6(*p*) illustrate various exemplary methods for constructing exemplary embodiments of a soil stabilization system.
Figure 6B:
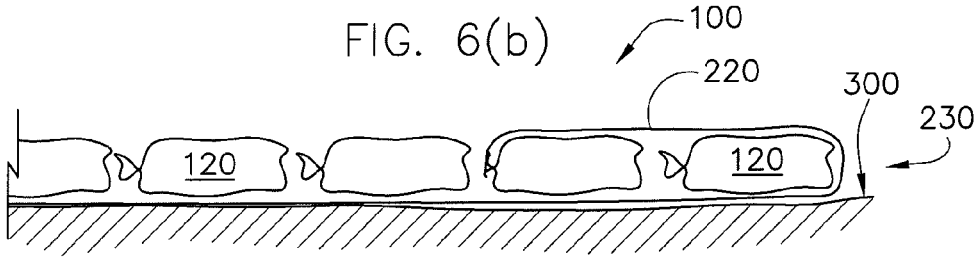
Figure 6C:
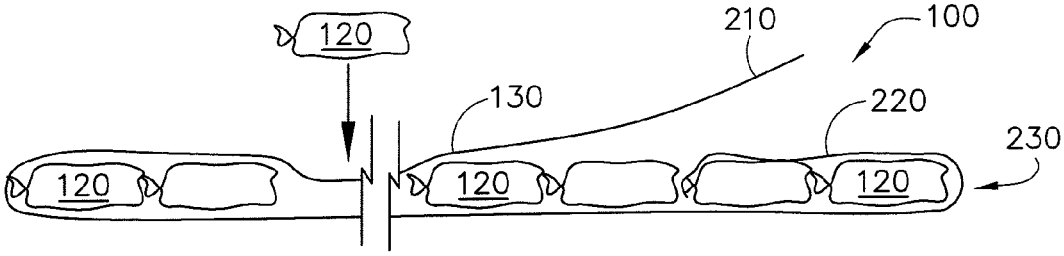
Figure 6D:
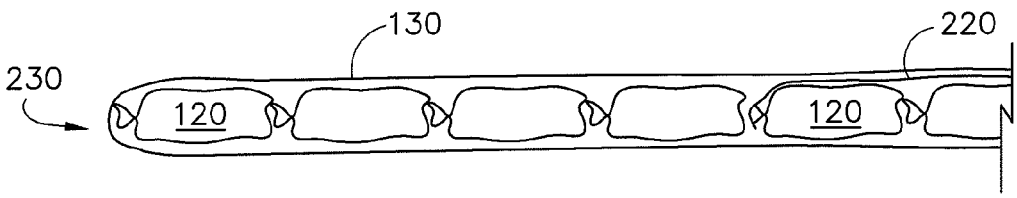
Figure 6J:
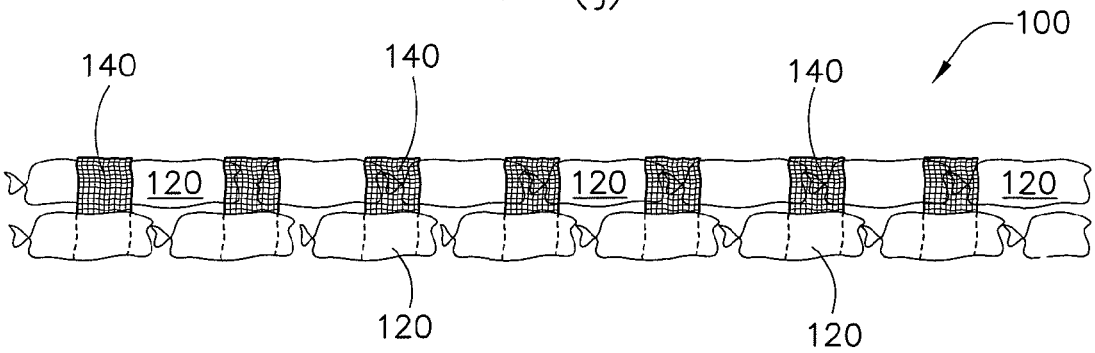
Figure 6K:
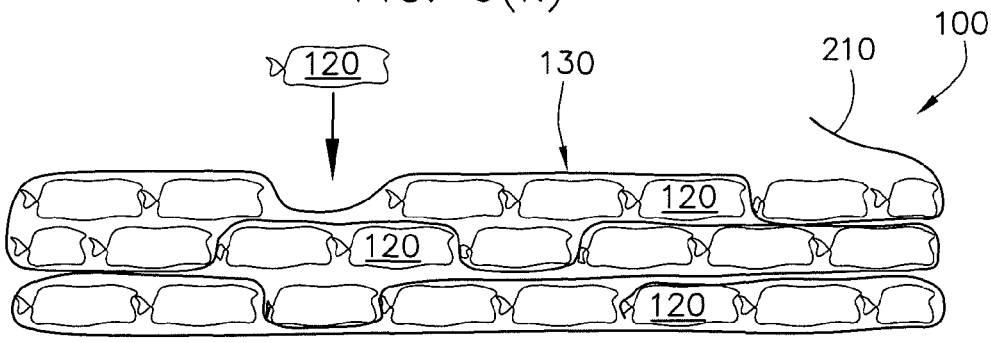
Figure 6L:
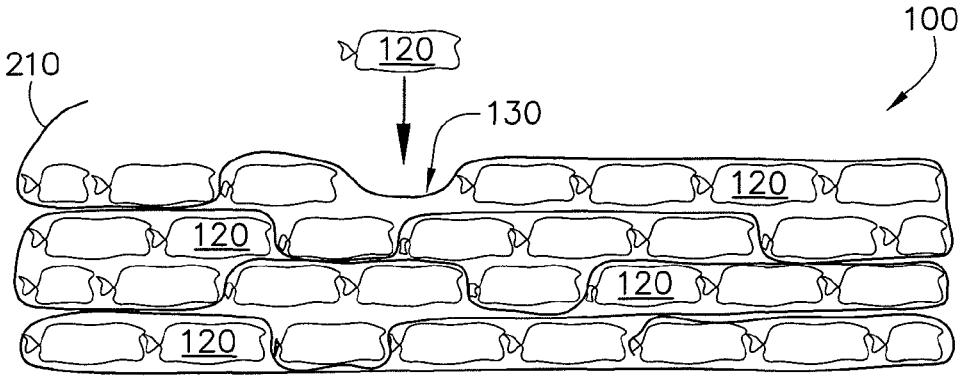
Figure 6M:
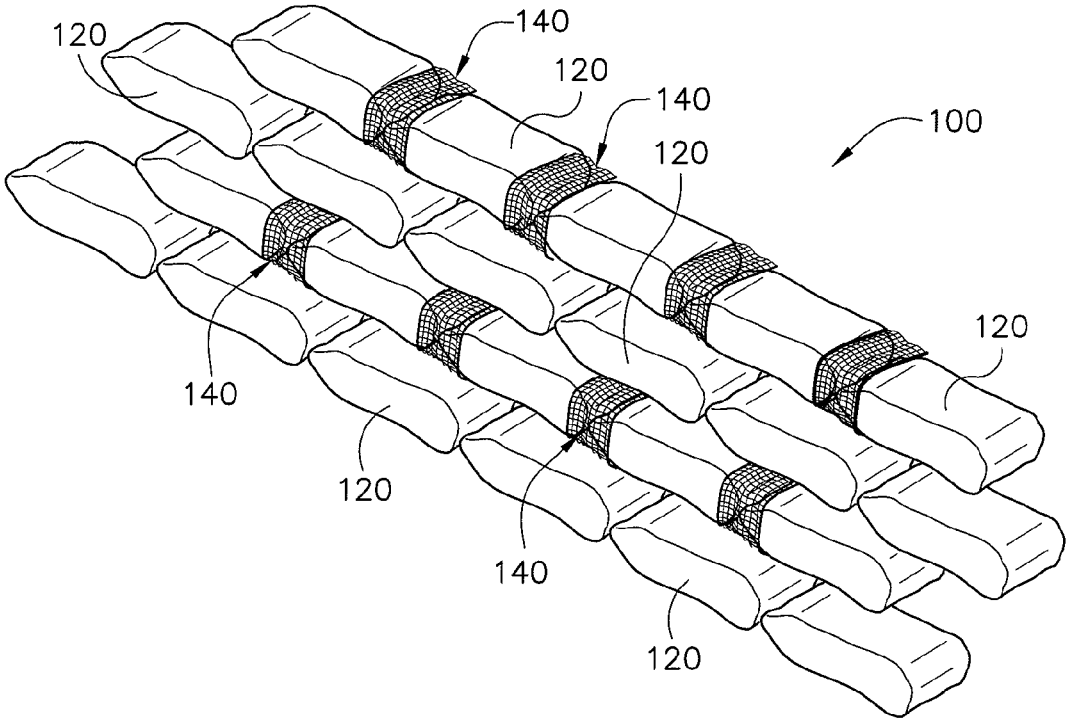
Figure 6N:
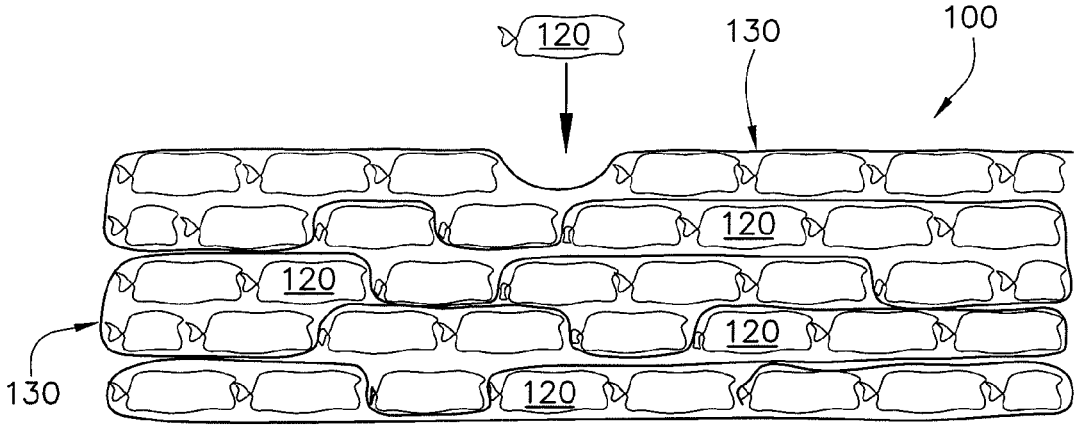

Referring to FIGS. 4-5, a perspective view and a side view of an exemplary embodiment of a soil stabilizer body 150 of the present invention are shown. As shown in FIG. 4, in one exemplary embodiment, the soil stabilizer body 150 includes a circular-shaped outer frame 160; however, it is contemplated that the outer frame 160 may be formed in any of a variety of geometric shapes, including, without limitation, a trapezoid, rectangle, polygon, circle and/or oval.

In one embodiment, a plurality of truss members 170 extend within the margin of the outer frame 160 to provide additional structural support to the soil stabilizer body 150. In one embodiment, a plurality of truss members 170 extend from the margin of the outer frame 160 to form a transverse web.

In one embodiment, the soil stabilization body 150 comprises at least one inner frame 190 interconnected to the truss members 170. Each truss member 170 and the inner frame 190 and outer frame 160 define, at least in part, a plurality of passages within the margins of the outer frame 160. While the truss members 170, inner frame 190 and outer frame 160 are shown in FIG. 4 as having a rectangular cross section, the truss members may be tubular, rectangular, or take other cross-sectional forms.

As shown in FIG. 4, in one embodiment, the collective passages are relatively large with respect to the overall structure of the soil stabilizer body 150. For example, in various embodiments, it is contemplated that the collective passages may cover or otherwise comprise from 30% of the soil stabilizer body 150 up to and including 80% or more of the soil stabilizer body 150. Thus, the frame and truss members of the body 150 are adapted to bear against the outer surface of a soil bag, while permitting moisture and the roots of vegetation to freely pass through the body members and into the soil bags.

In one embodiment, the soil stabilization body 150 includes a protruding member 180 extending from each side of the body. Each protruding member 180 may be of any shape or rigidity suitable for protruding spike-like into a soil bag. At least one of the distal ends of at least one protruding member 180 is generally tapered. In one embodiment, at least one of the distal ends of at least one protruding member 180 is substantially pointed, such as a spike or cleat. In the embodiment shown in FIGS. 4 and 5 the protruding members each comprise a plurality of radiating longitudinal ribs which resist twisting of the soil stabilization body 150 when the protruding members 180 are embedded in a soil bag.

It is contemplated that the soil stabilizer body 150 may be formed from a variety of materials or combinations of materials. For example, a soil stabilizer body 150 may be formed from plastic material. Additionally, the soil stabilizer body 150 may be formed from a biodegradable and/or photo-degradable material. For example, the soil stabilizer body 150 may be formed from a "green plastic," such as corn starch polymer, wheat germ polymer, or other similar materials that eventually decompose to an organic material.

FIGS. 6(*a*)-6(*p*) illustrate steps in an exemplary method for constructing a soil stabilization system 100 according to the present invention. In one embodiment, ground 300 or other surface is suitably prepared as needed or desired for construction of a soil stabilization system 100. For example, the ground 300 may be suitably prepared with a leveling pad or a concrete footing in order to support the retaining wall. Such ground 300 and/or surface preparation is conventional in the building of retaining walls.

Referring to FIG. 6(*a*), in one embodiment, at least one geogrid weaving strip 130 is placed on the ground 300 or other surface along the length of the soil stabilization system 100. In one exemplary embodiment, soil bags 120 are placed substantially above the geogrid weaving strip 130 at a first end of the soil stabilization system 100, and at a second end of the soil stabilization system 100, leaving a strip weaving end 210 at the first end of the soil stabilization system 100 and a strip remainder 220 at the second end of the soil stabilization system 100. Referring to FIG. 6(*b*), in one embodiment, a first plurality of soil bags 120 are then placed adjacent to each other on the geogrid weaving strip 130 between the soil bags 120 placed at the first and second ends of the soil stabilization system 100 to form a first course 230 of soil bags 120. While the individual bags appear to be slightly separated in FIGS. 6(*a*)-6(*p*), for ease of illustration and understanding, it should be understood that the bags in the soil stabilization system of the present invention will normally be in tight abutment with each other and tamped in a known manner to provide a substantially continuous barrier wall to contain and stabilize soil fill 400 or other structure existing or to be placed behind the wall. Each soil bag 120 may have a seam running the length of one side of the soil bag 120. In one or more exemplary embodiments, one or more soil bags 120 will be oriented in the soil stabilization system 100 seam side out to facilitate location of seeds for promoting plant growth, which seeds may be placed by hydroseeding of the finished wall. In one embodiment, the remainder 220 is wrapped around at least a portion of the soil bag 120 placed at the second end and over a portion of the first course 230 of soil bags 120 as shown in FIGS. 6(*b*)-6(*d*). In FIGS. 6(*c*)-6(*d*), the weaving end 210 is wrapped at least partially around the soil bag 120 placed at the first end of the soil stabilization system 100 and over at least a portion of the first course 230. It should be noted that the weaving end 210 may be wrapped at least partially around at least one soil bag 120 located between the first and second ends, if so desired.

Referring to FIGS. 6(*e*)-6(*f*), in one embodiment, at least one geogrid twining strip 140 will be placed substantially cross-wise to the weaving strip 130 and under at least one of the plurality of soil bags 120 forming the first course 230. The geogrid twining strips 140 may be oriented generally perpendicular to at least one of the longitudinal axes of the soil stabilization system 100 and the longitudinal axis of an overlying soil bag 120. The geogrid twining strips 140 may be positioned such that there is at least one twining end 250 left uncovered by the overlying soil bag 120. A twining remainder 260 may also remain uncovered by the soil bag, and may extend under the back fill (not shown) to be brought in and retained behind the soil bag wall being formed, or may be used for vertical double twining of the upwardly placed bags in the wall as shown in FIG. 6(*o*).

In one embodiment, the twining end 250 is wrapped around a side of a soil bag 120 and over the top of the soil bag 120. In one embodiment, the twining end 250 will be wrapped directly over a soil bag 120 and under a geogrid weaving strip 130. In one embodiment, the twining end 250 is wrapped around and over the soil bag 120 and the geogrid weaving strip 130 atop that soil bag.

While gaps are shown between soil bags 120 in FIGS. 6(*a*)-6(*p*), the gaps are shown for ease of illustration. In various embodiments, the soil bags 120 will commonly be placed together tightly. Further, the geogrid weaving strips 230 and geogrid twining strips 240 should be woven and twined, respectively, quite tightly to the soil bags 120 and/or soil stabilization system 100.

For example, as shown in FIGS. 6(*c*), 6(*h*), 6(*k*), 6(*l*) and 6(*n*), as various courses are added, at least one soil bag 120 in each course may be pulled out from underneath the geogrid weaving strip 130 and re-placed in substantially the same location above the geogrid weaving strip 130 to help cinch and tighten the geogrid weaving strip 130 within and over that course and otherwise anchor it within the soil stabilization system 100. Depending upon the length of each course of bags and the number of bags in each course, every third or fourth bag 120 in a course may be pulled from beneath the weaving strip 130 and replaced over the weaving strip back between the adjacent bags in its original position.

Referring to FIGS. 6(*g*)-6(*h*), in one embodiment, a second plurality of soil bags 120 are placed substantially above the first course 230 and at least one of the geogrid weaving strip 130 and geogrid twining strip 140 to form a second course 240 having a first end and a second end. In one embodiment, the weaving end 210 is wrapped around and over the soil bag 120 placed substantially at the second end of the second course 240 of the soil stabilization system 100 and over at least a portion of the second course 240. FIGS. 6(*g*)-6(*a*) also show that it is advantageous to employ soil bags tied at the one-half full level at one end of a course of bags so that as the wall goes up, the bags will be staggered in brick-like fashion so that the full bags of each course rest upon each of two bags of the previous course. Alternatively, a full bag can be turned 90° at the end of a course to simulate a half full bag and maintain the overlapping positioning of the full bags.

As shown in FIG. 6(*i*), in one embodiment, the twining end 250 of at least one geogrid twining strip 140 is wrapped at least partially around and over a soil bag 120. In one embodiment, the twining end 250 may be wrapped directly over a soil bag 120 and under the geogrid weaving strip 130 substantially atop the second course of soil bags 120. In one embodiment, the twining end 250 is wrapped around and over the soil bag 120 and the geogrid weaving strip 130 above that soil bag 120. As further shown in FIGS. 6(*i*), 6(*j*), 6(*m*) and 6(*p*), the twining strip 140 may alternately pass around a single bag, then the end portion of the two bags lying on the single bag, and then a single bag lying on the two bags, and so on to bind the courses of bags together as a single unit. The twining strip 140 may be located at any point or points along the soil bag wall and bind any portions of the bags lying in a vertical path upwardly from such point in a single twined or double twined manner.

In an exemplary embodiment, the soil bags 120 of the second course 240 should be positioned such that each soil bag 120 comprising the second course 240 of soil bags 120 is placed on top of two soil bags 120 in the first course 230 in any staggered manner. In such an embodiment, completion of the second course 240 may require utilization of a less than a full soil bag 120 or lateral orientation of at least one soil bag 120.

As shown in FIG. 6(*i*), in one embodiment, one or more soil stabilizer bodies 150 may also be used in connection with the soil stabilization system 100. In one exemplary embodiment, a plurality of soil stabilizer bodies 150 are placed over the geogrid strips 130/140 positioned above the soil bags 120 with the protrusions protruding down through holes in the geogrid strips 130/140 into the soil bags 120. In one embodiment, the soil stabilizer bodies 150 may also be placed directly on top of soil bags 120 and the geogrid strips 130/140 may then be placed on top of the soil stabilizer bodies 150 and soil bags 120 so that the protruding member of the soil stabilizer body 150 protrudes through holes in the geogrid strips 130/140. In one embodiment, when a second course 240 of soil bags 120 is put atop a first course of soil bags 120, protruding members of the soil stabilizer body 150 will extend both into the underside of the second course 240 and through the geogrid strips 130/140 and into the top of the soil bags 120 in that first course 230. The soil stabilizer bodies 150 may advantageously be placed, two on a bag, so that the bags of the next course, placed across the abutting ends of two bags in overlapping position, will each be engaged by two stabilizer bodies 150, one projecting upward from each underlying overlapped bag.

Throughout the construction of the soil stabilization system 100, one or more soil bags 120 may advantageously be tamped down in a conventional manner to help compact the soil bags 120 and/or help one or more soil stabilizer bodies 150 in contact with the soil bags 120 to be pierced by a protruding member of the soil stabilizer body 150.

As shown in FIGS. 6(*k*)-6(*p*), construction of the wall may be continued in the same or similar manner until a soil stabilization system 100 of the required dimensions is completed. For example, additional courses may be added. During the construction of the soil stabilization system 100, it may be necessary or desirable to utilize multiple geogrid weaving strips 130 and/or geogrid twining strips 140 during construction of the soil stabilization system 100. Geogrid strips 130/140 may be tied together to lengthen the strips to allow completion of the soil stabilization system 100. In another embodiment, the ends of the geogrid strips 130/140 may be wrapped around one or more soil bags 120 to help lock the geogrid strips 130/140 into place. In one embodiment, soil stabilization bodies 150 may be used to help anchor one or more geogrid strips 130/140 to the soil stabilization system 100 and to each other as desired.

In one embodiment, as discussed above, the soil bags 120 may contain a variety of seeds for vegetating at least a portion of the soil stabilization system 100. To expedite the vegetation process, more mature vegetation 160 may be planted in the soil bags comprising the soil stabilization system 100. Any combination of native plants, plugs, sod and seed may be so implanted. To implant the plants, plugs, sod and/or seed, one or more of the soil bags comprising the soil stabilization system 100 should be hydrated. In one exemplary embodiment, each soil bag is thoroughly soaked with water. By hydrating soil bags of the soil stabilization system 100, the material comprising the soil bags may be punctured with minimal loss of soil and other soil bag content.

In one embodiment, any number of soil bags may be punctured where native plugs are to be inserted. One or more plugs may be inserted into each soil bag. In one exemplary embodiment, three native plugs are inserted into the top front face of a plurality of soil bags. The plugs may be pushed deeply into the soil bag until the soil bag fabric closes over the top of the soil core of the plug, leaving only the crown of the plug exposed. In one embodiment, the soil bag is tamped closely around the throat of the plug after insertion of the plug into the soil bag.

Plants, sod and/or seed may also be inserted between soil bags. In one exemplary embodiment, plants, sod and/or seed may be planted substantially where three soil bags meet and more specifically where two soil bags meet atop a soil bag of an underlying course. Flats made of sod may also be graded into the soil stabilization system 100. In one embodiment, sod may be cut into strips and added between the soil bags and the outside of the soil bags as desired.

Vegetation of the soil stabilization system may be continued in the same manner, as desired. After the soil stabilization system is vegetated, the soil stabilization system may be watered immediately to help insure that vegetation 160 is hydrated.

The soil stabilization system 100 of the invention, consisting in combination of soil bags 120, interwoven geogrid weaving and twining strips 130/140, soil stabilizer bodies 150 and fibrous vegetation 160, or selected ones thereof, effectively provides a uniform wall or other soil stabilization structure which will stabilize soil or fill material 400 retained behind the structure to minimize soil erosion in a substantially permanent manner, with the capability of becoming stronger and more securely bound together as the fibrous vegetation grows and matures.

While various embodiments of the present invention have been described in detail, it is apparent that modifications and alterations of those embodiments will occur to those skilled in the art. However, it is to be expressly understood that such modifications within the scope and spirit of the present invention, as set forth in the following claims.

What is claimed is:

1. A soil stabilization system comprising:

a first plurality of soil bags positioned adjacent to one another forming a first course;

at least one additional plurality of soil bags positioned adjacent to one another above the first course, each additional plurality of adjacent soil bags successively-forming an additional-course positioned above a lower course;

at least one geogrid strip contiguously woven or twined between and at least partially around each course and at least any course positioned next above that course to bind the bags of the successive courses together in a stable structure; and at least one soil stabilization body at least partially positioned between the first course and a second course of the additional course, wherein the soil stabilization body comprises a plurality of protrusions configured to engage at least one soil bag of each of the first course and the second course.

2. The soil stabilization system of claim 1, wherein at least one geogrid weaving strip extends substantially across the upper surface of at least one course of soil bags, and wherein at least one soil bag of said one course of soil bags is positioned above said weaving strip and between adjacent bags in said one course to tighten and cinch the weaving strip across the upper surface of the course and anchor the weaving strip within the system.

3. The soil stabilization system of claim 2, wherein at least one geogrid weaving strip extending substantially across the upper surface of at least one course of soil bags is cinched under a plurality of bags at an end of the course and wrapped upwardly around an end bag and over and across the upper surface of an end bag and additional adjacent bags of the next above additional course of soil bags to bind the said end bags and the said next above additional course of soil bags within the soil stabilization system.

4. The soil stabilization system of claim 1, wherein the soil bags have coverings with openings therein and the geogrid weaving and twining strips have openings therein, said openings being of sufficient desired size to permit vegetation to grow and extend through such openings, and wherein vegetation selected from the group consisting of plugs, plants, sod and/or seeds implanted within and/or outside such bags grows and extends through such bags and geostrips to anchor the system together and resist erosion or other physical displacement of the system elements.

5. The soil stabilization system of claim 1, wherein the soil stabilization body further comprises a plurality of truss members extending within a frame to form a transverse web with passages formed therethrough and the plurality of protrusions at least partially supported by the transverse web to each penetrate and engage at least one soil bag of each of the first course and the second course; wherein the soil bags have coverings with openings therein and the geogrid weaving and twining strips have openings therein, said openings being of sufficient desired size to permit vegetation to grow and extend through such openings, and wherein at least one stabilization body protrusion, and vegetation selected and grown from the group consisting of plugs, fibrous plants, sod and/or seeds implanted within and/or outside such bags, extend through various such bag and geostrip openings to anchor the system together and resist erosion or other physical displacement of the system elements.

6. A method of constructing a soil stabilization system comprising:

placing a plurality of soil bags above a portion of a geogrid strip to form a first course of soil bags, wherein at least a weaving or twining end of the geogrid strip remains uncovered by the first course of soil bags;

wrapping the end of the geogrid strip at least partially around and over at least one soil bag forming the first course;

placing at least one soil stabilization body at least partially positioned above the first course, wherein the soil stabilization body comprises a protrusion configured to engage at least one soil bag of the first course;

placing at least one additional course of soil bags above the first course and at least a portion of the geogrid strip;

engaging a second protrusion of the soil stabilization body with at least one soil bag of the additional course; and wrapping the end of at least one geogrid strip positioned beneath at least one bag of each course underlying an additional course at least partially around and over at least one soil bag of the next overlying additional course to bind the wrapped bags of the soil stabilization system in a stable structure.

7. The method of constructing the soil stabilization system of claim 6, further comprising:

placing at least one geogrid strip under at least one overlying soil bag of at least one course wherein at least one twining end of the geogrid strip remains uncovered by the overlying soil bag; and wrapping at least one twining end of the geogrid strip around and over the soil bag overlying the geogrid strip and at least partially around and over at least one overlying soil bag of at least one additional course of overlying soil bags to further bind the wrapped bags together within the stable structure.

8. The method on constructing a soil stabilization system of claim 6, further comprising:

placing a plurality of soil bags above a portion of a geogrid strip to form a first course of soil bags, wherein at least one weaving end of the geogrid strip remains uncovered by the first course of soil bags;

wrapping the at least one weaving end of the geogrid strip at least partially around and over at least one soil bag forming the first course;

placing at least one additional course of soil bags above the first course and at least a portion of the geogrid strip; and wrapping the weaving end of the geogrid strip at least partially around and over at least one soil bag of at least one additional course of soil bags to bind the wrapped bags together.

9. The method of constructing the soil stabilization system of claim 8, wherein the step of wrapping a geogrid weaving strip over at least one course of bags includes the step of removing at least one bag from the course and then placing the bag over the weaving strip and forcing the bag back into place between adjacent bags in the course to tighten and cinch the remainder of the weaving strip across the upper surface of the course to anchor the weaving strip and wrapped bags within the system.

10. The method of constructing the soil stabilization system of claim 6, including the step of selecting vegetation from the group consisting of plugs, fibrous plants, sod and/or seeds and implanting such vegetation within and/or outside such bags and hydrating the bags to facilitate the growth of such vegetation through openings in such bags and geostrips to increasingly anchor the system together and resist erosion or other physical displacement of the system elements.

11. A soil stabilization system comprising:

a first plurality of soil bags positioned adjacent to one another forming a first course; a second plurality of soil bags positioned adjacent to one another above the first course forming a second course;

at least one geogrid strip contiguously woven or twined between and at least partially around the first course and at least partially around the second course; and at least one soil stabilization body positioned between the first course and the second course, wherein the soil stabilization body comprises a plurality of truss members extending within a frame to form a transverse web with passages formed therethrough and a plurality of protrusions at least partially supported by the transverse web to engage at least one soil bag of the first or second course.

12. The soil stabilization system of claim 11, wherein the plurality of protrusions include a first protruding member located in a planar center of the transverse web connected to each of the plurality of truss members and extending in a first direction perpendicular to the plane of the transverse web to penetrate and engage at least one soil bag of the first course, and a second protruding member located in the planar center of the transverse web connected to each of the plurality of truss members and extending in a second opposite direction perpendicular to the plane of the transverse web to engage at least one soil bag of the second course, wherein the area between any two adjacent truss members and at least one of the first and second protruding members, defines at least one open and permeable passage.

13. The soil stabilization system of claim 11 wherein an outer frame of the soil stabilization body has the shape of an outer loop, and an inner frame of the body has the shape of an inner loop, and the outer frame and the inner frame and at least one pair of spaced truss members define at least one open passage.

14. The soil stabilization system of claim 11, wherein each of the plurality of protrusions comprises a plurality of radiating longitudinal ribs connected to each other along joined inner edges; and the longitudinal ribs are tapered at their distal ends to form a point to facilitate penetration and engagement of a soil bag.

15. A soil stabilization system comprising:

a first plurality of soil bags positioned adjacent to one another forming a first course;

at least one additional plurality of soil bags positioned adjacent to one another above the first course, each additional plurality of adjacent soil bags successively forming an additional course positioned above the lower course;

at least one geogrid strip contiguously woven or twined between and at least partially around each course and at least any course positioned above that course to bind the bags of the successive courses together in a stable structure;

at least one soil stabilizer body positioned between at least one lower course and at least one additional course, wherein the soil stabilizer body comprises:

an outer frame having the shape of a first closed loop;

an inner frame having the shape of a second closed loop;

a plurality of truss members extending from the outer frame to the inner frame and towards the interior of the second closed loop; wherein the outer frame, the inner frame and the plurality of truss members form a transverse web, the transverse web being generally planar;

a first protruding member located in a planar center of the transverse web, connected to each of the plurality of truss members and extending in a first direction perpendicular to the plane of the transverse web to engage at least one soil bag of a lower course; and a second protruding member located in the planar center of the transverse web, connected to each of the plurality of truss members and the first protruding member and extending in a second opposite direction perpendicular to the plane of the transverse web to engage at least one soil bag of an additional course;

wherein the area between any two adjacent truss members, at least one of the outer frame and the inner frame and at least one of the first and second protruding members, defines at least one open and permeable passage.

16. A soil stabilization system comprising:

a first plurality of soil bags positioned adjacent to one another forming a first course;

at least one additional plurality of soil bags positioned adjacent to one another above the first course, each additional plurality of adjacent soil bags successively-forming an additional-course positioned above a lower course;

at least one geogrid strip contiguously woven or twined between and at least partially around each course and at least any course positioned next above that course to bind the bags of the successive courses together in a stable structure; and a spike member configured to engage at least one soil bag of each of the first course and a second course of the additional course.

17. The soil stabilization system of claim 16, wherein at least one geogrid weaving strip extends substantially across the upper surface of at least one course of soil bags, and wherein at least one soil bag of said one course of soil bags is positioned above said weaving strip and between adjacent bags in said one course to tighten and cinch the weaving strip across the upper surface of the course and anchor the weaving strip within the system.

18. The soil stabilization system of claim 16, wherein at least one geogrid weaving strip extending substantially across the upper surface of at least one course of soil bags is cinched under a plurality of bags at an end of the course and wrapped upwardly around an end bag and over and across the upper surface of an end bag and additional adjacent bags of the next above additional course of soil bags to bind the said end bags and the said next above additional course of soil bags within the soil stabilization system.

19. The soil stabilization system of claim 16, wherein the soil bags have coverings with openings therein and the geogrid weaving and twining strips have openings therein, said openings being of sufficient desired size to permit vegetation to grow and extend through such openings, and wherein vegetation selected from the group consisting of plugs, plants, sod and/or seeds implanted within and/or outside such bags grows and extends through such bags and geostrips to anchor the system together and resist erosion or other physical displacement of the system elements.

20. The soil stabilization system of claim 16, wherein the spike member comprises a plurality of truss members extending within a frame to form a transverse web with passages formed therethrough and a plurality of protrusions at least partially supported by the transverse web to each penetrate and engage at least one soil bag of each of the two courses; wherein the soil bags have coverings with openings therein and the geogrid weaving and twining strips have openings therein, said openings being of sufficient desired size to permit vegetation to grow and extend through such openings, and wherein at least one spike member protrusion, and vegetation selected and grown from the group consisting of plugs, fibrous plants, sod and/or seeds implanted within and/or outside such bags, extend through various such bag and geostrip openings to anchor the system together and resist erosion or other physical displacement of the system elements.

* * * * *